US006302784B1

(12) United States Patent
Berger

(10) Patent No.: US 6,302,784 B1
(45) Date of Patent: Oct. 16, 2001

(54) MODULAR AIR VENT ASSEMBLY KIT

(75) Inventor: Brian K. Berger, Ballwin, MO (US)

(73) Assignee: Innovative Vent Solutions, Inc., Pacific, MO (US)

( * ) Notice: Subject to any disclaimer, the term of this patent is extended or adjusted under 35 U.S.C. 154(b) by 0 days.

(21) Appl. No.: 09/638,817

(22) Filed: Aug. 14, 2000

(51) Int. Cl.[7] ..... F24F 7/00
(52) U.S. Cl. ..... 454/289; 454/290; 454/331
(58) Field of Search ..... 454/290, 289, 454/318, 325, 309, 335, 331, 332

(56) References Cited

U.S. PATENT DOCUMENTS

| | | | | |
|---|---|---|---|---|
| 524,310 | * | 8/1894 | Cohen | 454/290 |
| 637,519 | | 11/1899 | Mertins . | |
| 770,326 | | 9/1904 | Slater . | |
| 1,429,811 | | 9/1922 | Tynan . | |
| 1,692,775 | | 11/1928 | Hart . | |
| 1,841,347 | | 1/1932 | Tuttle . | |
| 1,911,851 | | 5/1933 | Scholtz . | |
| 2,210,023 | | 8/1940 | Candor . | |
| 2,575,499 | | 11/1951 | Manow . | |
| 2,587,633 | | 3/1952 | Levin . | |
| 3,220,079 | | 11/1965 | Aggson . | |
| 3,280,984 | | 10/1966 | Sexton et al. . | |
| 3,313,226 | | 4/1967 | Johnson . | |
| 3,509,812 | * | 5/1970 | James | 454/290 |
| 3,802,168 | | 4/1974 | Deckas . | |
| 4,185,657 | | 1/1980 | McCabe . | |
| 4,208,010 | | 6/1980 | Beam, Jr. et al. . | |
| 4,334,899 | | 6/1982 | McConnell . | |
| 4,345,510 | | 8/1982 | Sterett . | |
| 4,404,990 | | 9/1983 | McCabe . | |
| 4,460,394 | | 7/1984 | Wrightson . | |
| 4,610,197 | | 9/1986 | Van Becelaere . | |
| 4,900,344 | | 2/1990 | Lansing . | |
| 5,100,445 | | 3/1992 | Johnson et al. . | |
| 5,163,871 | | 11/1992 | Huibregtse et al. . | |
| 5,176,570 | | 1/1993 | Liedl . | |
| 5,472,380 | | 12/1995 | Sarazen, Jr. et al. . | |
| 5,474,184 | | 12/1995 | Mandler et al. . | |
| 5,482,506 | | 1/1996 | Tsuda et al. . | |
| 5,586,933 | | 12/1996 | Sawyer et al. . | |
| 5,643,081 | | 7/1997 | Klein . | |
| 5,766,285 | | 6/1998 | Killman . | |
| 5,984,776 | | 11/1999 | Berger . | |
| 6,012,260 | * | 1/2000 | Hendrick et al. | 52/302.1 |

FOREIGN PATENT DOCUMENTS

| | | |
|---|---|---|
| 165436 | 1/1934 | (CH) . |
| 1344134 | 1/1963 | (FR) . |

* cited by examiner

*Primary Examiner*—Harold Joyce
*Assistant Examiner*—Derek S. Boles
(74) *Attorney, Agent, or Firm*—Howell & Haferkamp, LC

(57) ABSTRACT

A modular air vent assembly kit can be used to cover duct openings that supply a flow of heated or cooled air to a room in addition to covering duct openings that receive return air from a room. The modular air vent assembly kit is comprised of a base, a damper mechanism, and two different faceplates where the damper mechanism can be selectively assembled into the base depending on whether control through the air vent by operation of a damper is needed in the particular duct opening and where either of the two faceplates may be selectively connected with the base where one faceplate has a lattice and is used in combination with the damping mechanism and the other faceplate has a series of louvers and is used when the damping mechanism is not used in the vent assembly.

19 Claims, 5 Drawing Sheets

MODULAR AIR VENT ASSEMBLY KIT

BACKGROUND OF THE INVENTION (1) Field of the Invention

The present invention pertains to a modular air vent assembly kit that can be used to cover duct openings that supply a flow of heated or cooled air to a room in addition to covering duct openings that receive return air from a room. In particular, the modular air vent assembly kit of the invention is comprised of a base, a damper mechanism, and two different faceplates where the damper mechanism can be selectively assembled into the base depending on whether control through the air vent by operation of a damper is needed in the particular duct opening and where either of the two faceplates may be selectively connected with the base where one faceplate has a lattice and is used in combination with the damping mechanism and the other faceplate has a series of louvers and is used when the damping mechanism is not used in the vent assembly.

(2) Description of the Related Art

In many HVAC systems, and in particular in HVAC systems used in households, the network of air ducts that make up the system communicate with two groups of outlets or openings, one group providing an outlet for cooled or heated air and the other group providing an inlet for return air to the HVAC system. These two different groups of openings are usually covered by two different types of air vent assemblies.

Air vent assemblies that cover return air openings or inlets of HVAC systems are commonly constructed as rectangular panels that have a grill or a series of louvers that conceal the return air inlet opening but do not appreciably restrict the flow of return air through the inlet opening. Air vent assemblies that cover air outlet openings of the HVAC system typically include some time of damper mechanism that can control the flow of air through the outlet opening. The damper mechanism is assembled into a base of the air vent assembly and can be operated to completely close the air outlet opening and to open the air outlet opening in varying degrees. The outlet air vent assembly also includes a faceplate that is attached to the base and conceals the damper mechanism and the air outlet opening from view, but does not appreciably obstruct the flow of air through the outlet opening. The faceplate includes a lattice that conceals the air outlet opening, and the lattice can be constructed as a series of louvers or can be given a more ornamental appearance.

The need for having two different types of faceplates to cover air outlet openings and air inlet openings of an HVAC system contributes to the overall cost of the system. Air return or air inlet vent assemblies are typically comprised of a base that connects the assembly to the air return opening of the HVAC system and also connects with an air return faceplate that is specifically adapted for the particular base. In a like manner, air outlet vent assemblies are typically comprised of a base that attaches to the outlet opening of the HVAC system and includes the damper mechanism that is attached in the base, and the air outlet faceplate that covers over the base with the base, damper mechanism and faceplate being a pre-assembled unit.

SUMMARY OF THE INVENTION

The modular air vent assembly of the present invention is specifically designed to reduce the cost of HVAC systems by providing a kit of component parts that are used in both securing an air inlet faceplate over an air return duct opening of an HVAC system and in securing an air outlet faceplate and damper mechanism over an air outlet duct opening of an HVAC system. The air vent assembly kit of the invention is comprised of a base, a damper mechanism, and a pair of faceplates with one faceplate being intended for use in covering an air return inlet opening and the other faceplate being intended for use in covering an air outlet opening. The base is designed to be inserted and secured in both an air outlet opening and an air inlet opening and is also designed to have either of the faceplates selectively connected to the base. The base is also designed to have the damper mechanism selectively connected to or assembled in the base where desired. Thus, the base can be assembled into an air return opening without a damper mechanism in the base or the base can be assembled into an air outlet opening with the damper mechanism assembled in the base. With the base assembled in an air return opening, the desired faceplate of the two faceplates of the kit can be selectively connected to the base by connectors of the faceplate that are inserted into the base and connect the faceplate to the base without separate fasteners. In a like manner, with the base containing a damper mechanism assembled into an air outlet opening of an HVAC system, the desired faceplate of the two faceplates can be selectively connected to the base by inserting connectors of the faceplate into the base and thereby connecting the faceplate to the base without separate fasteners.

By providing a common base that can be used in air return openings and air outlet openings and by providing a set of faceplates that can be selectively connected to the same base whether they cover an air return opening or an air outlet opening, the modular air vent assembly kit of the present invention simplifies the assembly of the HVAC system and reduces the number of parts needed in assembling the HVAC system and thereby reduces the costs of its assembly.

BRIEF DESCRIPTION OF THE DRAWINGS

Further features of the invention are revealed in the following detailed description of the preferred embodiment of the invention and in the drawing figures wherein.

DETAILED DESCRIPTION OF THE INVENTION

Figure 1:
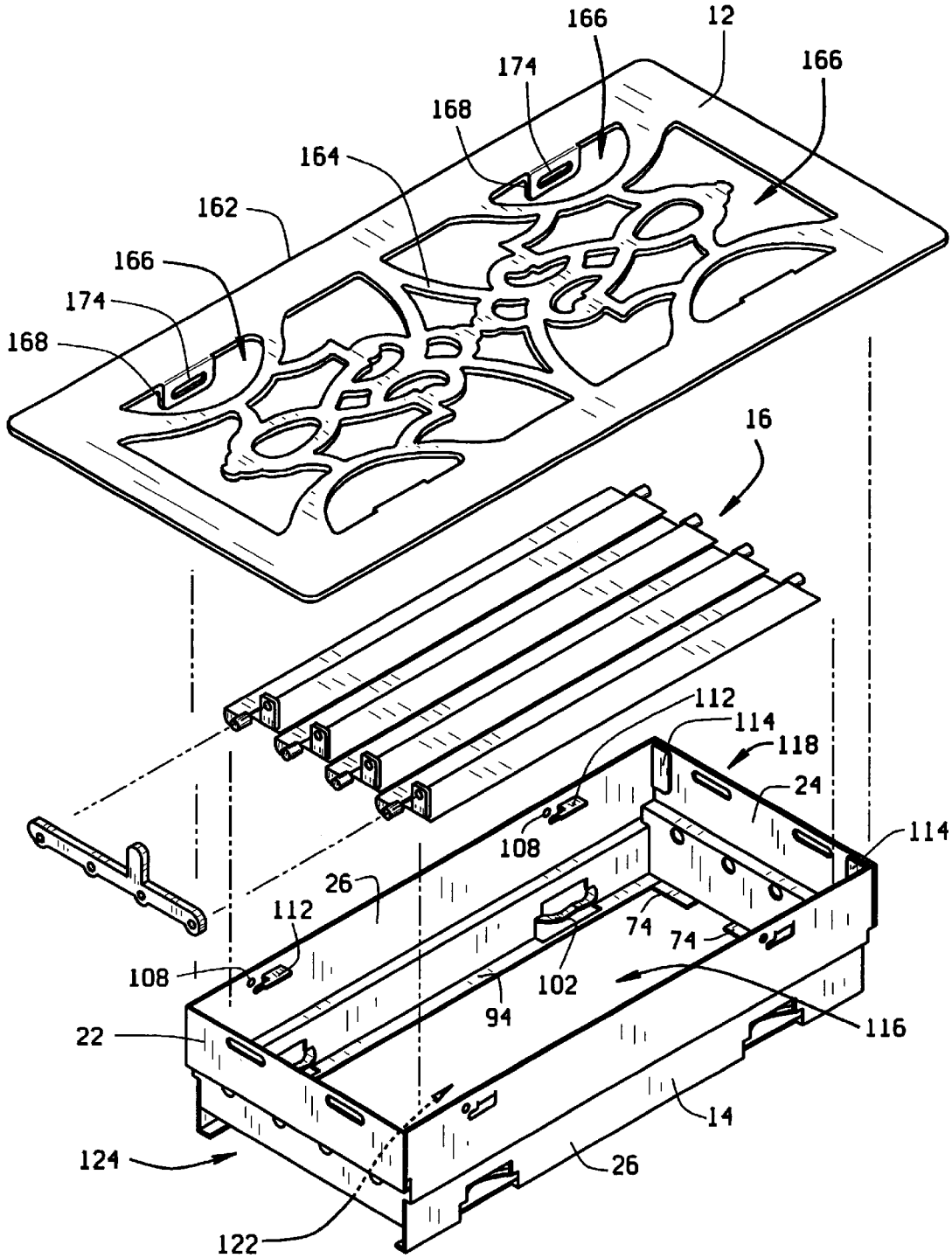
FIG. 1 is a perspective, exploded view of the air vent assembly kit of the invention.

The air vent assembly kit of the invention can be assembled in two different configurations, one of those two configurations being shown in FIG. 1. The air vent assembly configuration assembled from the kit shown in FIG. 1 includes a face plate 12, a base 14, and a damper mechanism 16. The other assembled configuration of the air vent assembly from the air vent assembly kit of the invention includes the same base 14 shown in FIG. 1 assembled to a different, second face plate 18 shown in FIG. 15. The second configuration of the air vent assembly assembled from the air vent assembly kit of the invention does not include the damper mechanism 16. In the preferred embodiment of the kit of the invention, both the first face plate 12 and second face plate 18, as well as the component parts that make up the base 14 and the damper mechanism 16 are all stamped from sheet metal making the air vent assembly kit of the invention inexpensive to manufacture. However, other materials such as plastics may be employed in constructing the component parts of the kit of the invention.

Figure 3:
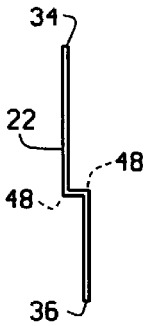
FIG. 3 is an end view of the base end wall of FIG. 2 following its forming.
Figure 2:
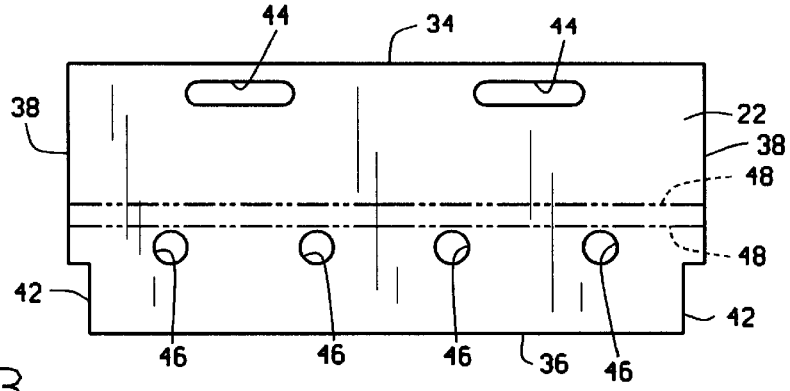
FIG. 2 is a side elevation view of an end wall of the base of the invention prior to forming.
Figure 5:
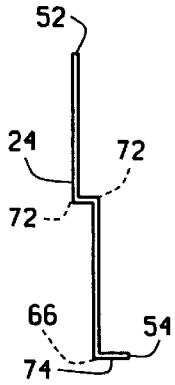
FIG. 5 is an end view of the end wall of FIG. 4 following its forming.
Figure 4:
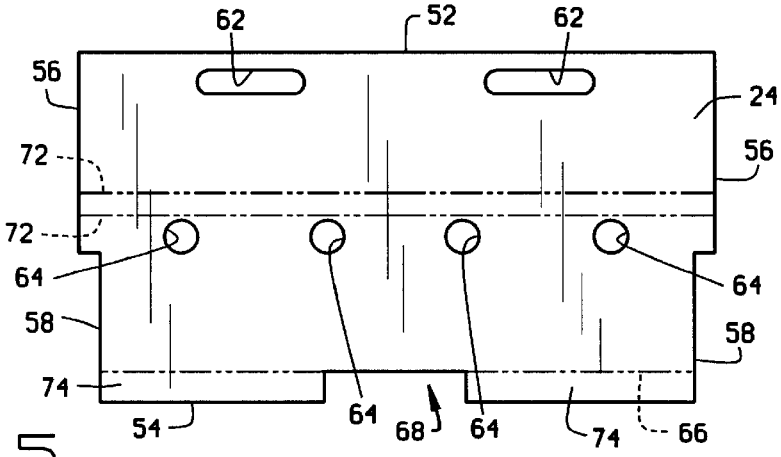
FIG. 4 is an elevation view of the second base end wall prior to its forming.
Figure 6:
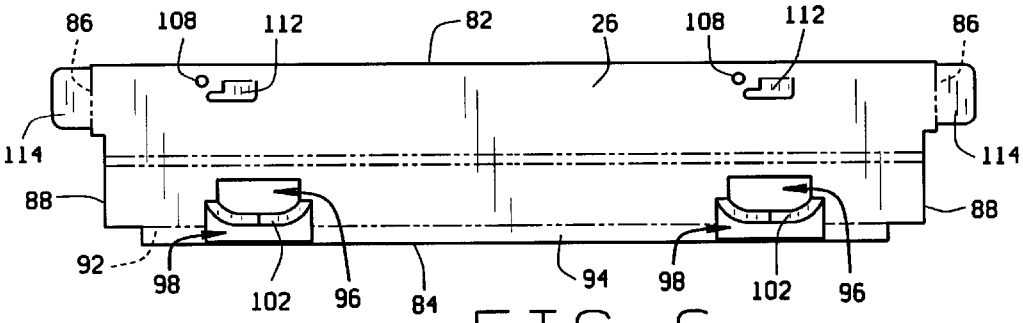
FIG. 6 is an elevation view of either of the side walls of the base prior to its forming.
Figure 7:
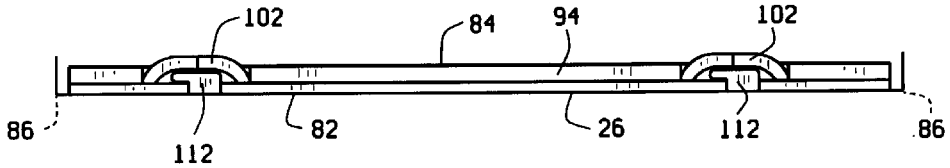
FIG. 7 is a top plan view of the side wall of FIG. 6 following its forming.
Figure 8:
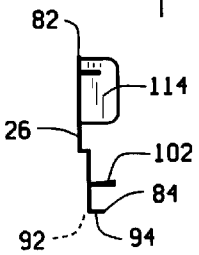
FIG. 8 is an end elevation view of the side wall of FIG. 6 following is forming.

The base 14 of the kit is constructed from a first base end wall 22 shown in FIGS. 2 and 3, a second base end wall 24 shown in FIG. 4 and 5 and a pair of identical base side walls 26 shown in FIGS. 6 and 7.

The two base end walls 22, 24 are not identical as the first base end wall 22 is slightly smaller than the second base end wall 24. FIG. 2 shows the first base end wall 22 as a flat, stamped piece of sheet metal. The end wall is formed with a top edge 34 and a parallel bottom edge 36, and opposite side edges with upper side edges 38 being spaced slightly farther apart than lower side edges 42. The first end wall is formed with a pair of oblong openings 44 adjacent is top edge 34 and with four smaller circular openings 46 that extend across the end wall adjacent its transition between the upper side edges 38 and the lower side edges 42. Just above the circular openings 46 the first end wall has two fold or bend lines 48. In the final construction of the first end wall 32 it is folded along the two bend lines 48 to the configuration shown in FIG. 3.

The second end wall 24 shown in FIG. 4, like the first end wall described above is a flat stamped piece of metal with a top edge 52 and an opposite bottom edge 54. However, the distance between the top edge 52 and bottom edge 54 of the second end wall is slightly larger than that of the first end wall. The second end wall is also formed with opposite side edges which include upper side edges 56 that are spaced farther apart than the bottom side edges 58. The second end wall also has oblong openings 62 adjacent its top edge 52 and four smaller circular openings 64 that extend across the end wall adjacent the transition between the upper side edges 56 and the lower side edges 58. The second end wall is also provided with a pair of fold or bend lines 66 that extend across the end wall. In addition, the bottom edge 54 of the second end wall has a notch 68 with a fold line 72 that extends across the bottom of the end wall from the notch. The notch 68 and the second fold lines 72 define a pair of flanges 74 that project outwardly from the second end wall 24 when the second end wall is bent along the bend lines 66, 72 to the configuration shown in FIG. 5.

The two base side walls 26 are the same and only one is shown in FIG. 6 and FIG. 7. In FIG. 6 the side wall is shown as a flat blank stamped from sheet metal including a top edge 82 and an opposite bottom edge 84 and opposite side edges that include upper side edges 86 and lower side edges 88. A fold or bend line 92 extends across the side wall adjacent the bottom edge 84 and defines a flange 94 that extends across the bottom of the side wall for almost its entire length. Pairs of two rectangular cut outs 96, 98 are made in the side wall adjacent but spaced from the bottom edge 84. An arcuate strip 102 of side wall material is left between the two rectangular cut outs 96, 98. Two more fold lines 104, 106 are formed in the side wall just above the pairs of rectangular cut outs 96, 98. Two circular indentations are made in the side wall that form circular projections 108 on the interior surface of the side wall. A pair of curved cut out lines are made in the side wall adjacent the pair of circular projections 108 that form tabs or projections 112 having a general L-shape. The upper side edges 86 of the side walls are spaced slightly farther apart than the lower side edges 88, and the upper side edges 86 are formed with flaps 114 that project from fold lines defined by the upper side edges 86.

In forming the side walls 26 of the base into their final configuration shown in FIG. 7, each of the bottom flanges 94, the arcuate strips 102, the L-shape tabs 112 and the side edge flaps 114 are bent in the same direction from the side wall as shown in FIG. 7. The side walls are also bent along the two intermediate fold lines 104, 106 in the manner shown in FIG. 7 to complete the construction of each side wall.

The first end wall 22 and the second end wall 24 are assembled to the pair of side walls 26 by spot welding or otherwise securing the pair of flaps 114 of each side wall 26 to the first 22 and second 24 end walls in the orientations shown in FIG. 1. With the assembled relative positions of the base end walls 22, 24 and the base side walls 26 shown in FIG. 1, the bottom flanges 94, the arcuate strips 102 and the L-shaped tabs 112 of each side wall project into the interior 116 of the base and the bottom flanges 74 of the second end wall 24 also project into the interior 116 of the base. The interior 116 of the base is accessible through a top opening 118 of the base as well as through a bottom opening 122 of the base. The dimensions of the first end wall 22 leave an opening slot 124 adjacent its bottom edge 36 that enables the insertion of a filter element in a rectangular frame (not shown) through the slot 124 between the bottom flanges 94 and the arcuate strips 102 of the side walls as well as on to the bottom flanges 74 of the second end wall 24 which securely hold the filter frame in place.

Figure 10:
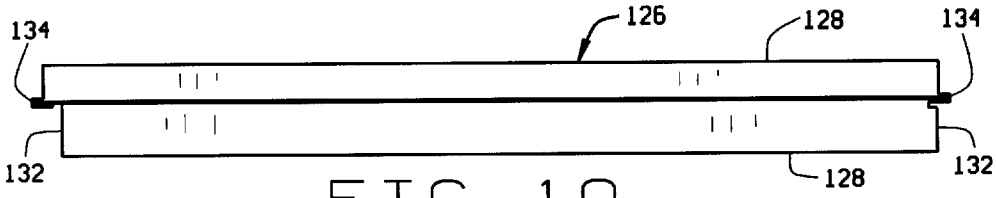
FIG. 10 is a plan view of the louver of FIG. 9 following its forming.
Figure 9:
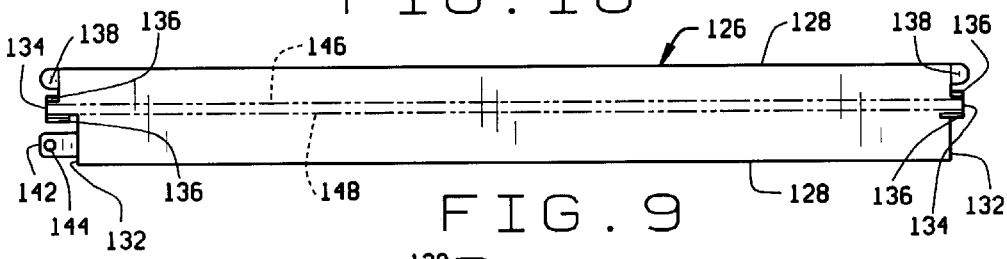
FIG. 9 is a plan view of a louver prior to its forming.
Figure 11:
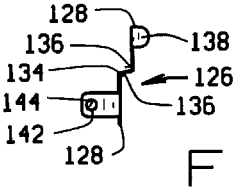
FIG. 11 is an end elevation view of the louver of FIG. 9 following its forming.

FIGS. 9 through 11 show the construction of a louver 126 of the damper mechanism 16 of the invention. FIG. 9 shows the louver 126 as a flat blank formed from sheet metal. The louver 126 has opposite, straight side edges 128 and opposite end edges 132. Each end edge 132 is formed with a projecting rectangular tab 134 with opposite side foldable margins 136 and a generally arcuate projecting tab 138. One of the end edges 132, the left side end edge as shown in FIG. 9, is also provided with a projecting flange 142 having a hole 144 passing therethrough. The louver is also provided with a pair of fold lines 146, 148 that extend across its length and separate the rectangular projecting tabs from their side edge margins 136. In forming the louver 126 into its final configuration shown in FIGS. 10 and 11, the louver is folded along the pair of fold lines 146, 148 in the manner shown in FIG. 11 and the side edge margins 136 of the pair of rectangular projecting tabs 134 are folded over on the tabs also as shown in FIG. 11. The opposite pair of arcuate projecting tabs 138 are bent at a right angle relative to the louver on one side of the louver and the louver flange 142 is bent at a right angle relative to the louver projecting from the opposite side of the louver relative to the arcuate tabs, as shown in FIG. 11. In the preferred embodiment of the invention, four damper mechanism louvers are formed in the same manner as the louver described above and as shown in FIGS. 9 through 11.

Figure 13:
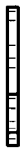
FIG. 13 is an end view of the louver actuator of FIG. 12.
Figure 12:
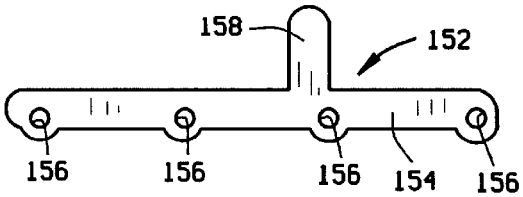
FIG. 12 is an elevation view of the louver actuator.

FIGS. 12 and 13 show the louver actuator that is assembled to the louvers 126 of the damper mechanism 16. The louver actuator is stamped from a flat sheet of metal in the configuration shown in FIG. 12 with an elongate bar 154 having a plurality of spaced openings 156 passing through the bar, and an actuator handle 158 projecting from the bar.

The louvers 126 and the louver actuator 152 of the damper mechanism 116 are assembled together and assembled into the interior 116 of the base in the manner shown in FIG. 1. Because the base end walls 22, 24 and each of the louvers 126 are constructed from flat sheets of metal, they are resiliently bendable. This enables each of the louvers 126 to be bent slightly to insert the projecting tabs 134 at the opposite ends of each louver into one of the circular openings 46, 64 of the first end wall 22 and the second end wall 24 of the base. Each of the louvers is assembled into the base in this manner with its flange 142 projecting toward the top opening of the base. The holes 156 of the louver actuator 152 are aligned with the louver flange holes 144 and the louver actuator is pivotally connected to each of the louver flanges 142 by a pin or other similar type of mechanical fastener inserted through the aligned holes. With the damper mechanism 16 thus assembled into the base 12, the actuator handle 158 can be moved between the opposite base side wall 26 to pivot the louvers between opened and closed positions in the base interior 116.

Figure 14:
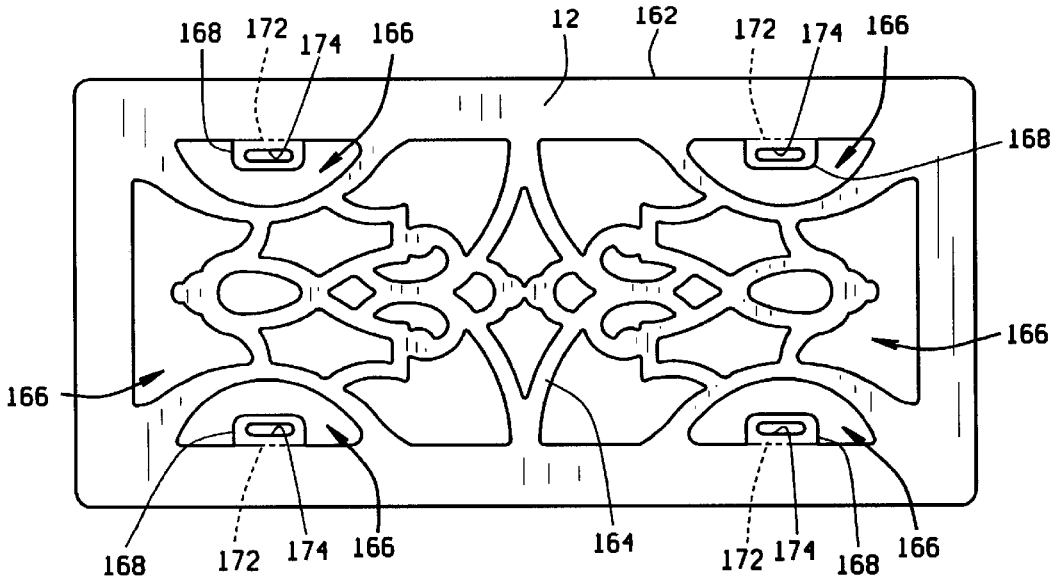
FIG. 14 is a plan view of the lattice face plate of the kit.

The first face plate 12 of the air vent assembly kit is shown in FIG. 14. Like the other component parts of the invention, the first face plate 12 is preferably stamped from a flat sheet of steel with a rectangular border 162 and a decorative lattice 164 in the interior of the border. In the stamping of the first face plate 12, preferably the interior of the rectangular face plate surrounding the lattice 164 is flat and portions of the face plate around the border 162 angle slightly downward from the top surface of the face plate. The lattice 164 is defined by a plurality of openings 166 stamped in the face plate. The face plate border 162 is also formed with four rectangular projecting tabs 168 that extend inwardly from the border 162 into four of the lattice openings 166. The projections or tabs 168 are connected to the face plate border 162 by fold lines 172. Each of the tabs has an oblong opening 174 passing through the tab. In the final construction of the first face plate 12, each of the tabs or projections 168 is bent downwardly across its fold line 172 so that the tabs project perpendicularly below the face plate 12.

The first face plate 12 with its decorative lattice 164 is designed to be used in the air vent assembly of the invention when the base 14 is assembled with the damper mechanism 16 and is to be used in an air outlet opening of an HVAC system. Moving the damper mechanism 16 between its opened and closed positions controls the flow of air through the air outlet opening of the HVAC system into which the air vent assembly has been inserted. The first face plate 12 is assembled to the base 14 by first positioning it over the top opening 118 of the base with each of the four face plate tabs or projections 168 positioned over one of the L-shaped tabs or projections 112 of the base. Pressing the first face plate 12 downward on top of the base 14 will result in the face plate tabs or projections 168 resiliently flexing inwardly toward each other as they pass over the L-shaped tabs or projections 112 of the base. The first face plate 12 is pressed downwardly until the L-shape projections or tabs 112 of the base pass into the openings 174 of the face plate tabs 168. The first face plate 12 is then moved to the right as viewed in FIG. 1 until the circular projections 108 on the interior of the base side walls 26 are positioned at the sides of each of the face plate tabs 168 and securely hold the tabs against movement on the L-shaped projections 112 of the base. In this manner the first face plate 12 is attached to the base 14 without separate fasteners. The first face plate 12 can be easily removed from the base 14 by reversing the steps described above.

Figure 19:
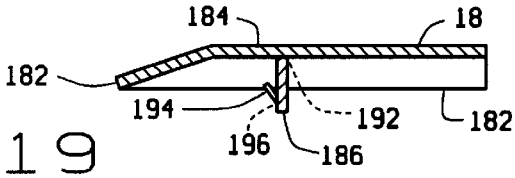
FIG. 19 is a partial section view of the louvered face plate of FIG. 15 from along the line 19—19.
Figure 15:
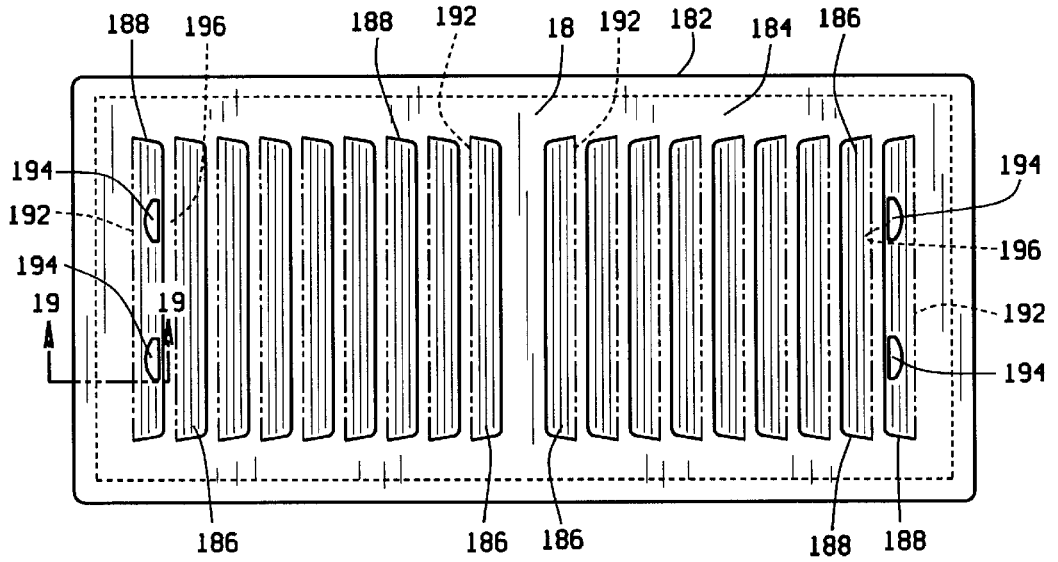
FIG. 15 is a plan view of the louvered face plate of the kit.
Figure 16:
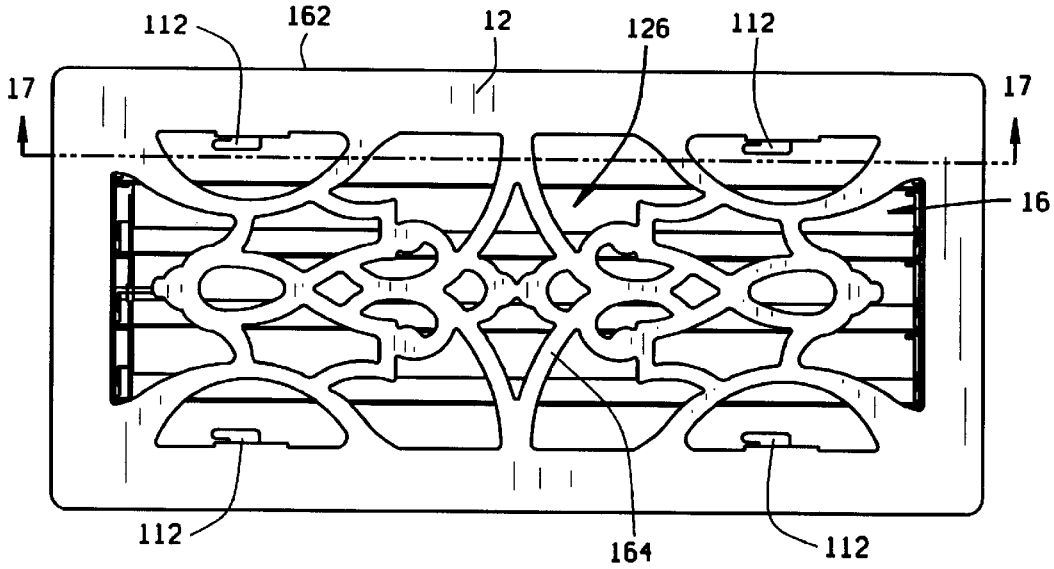
FIG. 16 is a plan view of the assembled air vent assembly kit with the lattice face plate.
Figure 17:
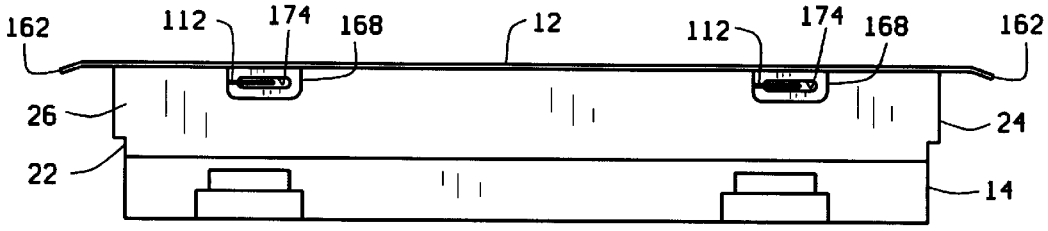
FIG. 17 is a side section view of the assembled air vent assembly kit of FIG. 16.
Figure 18:
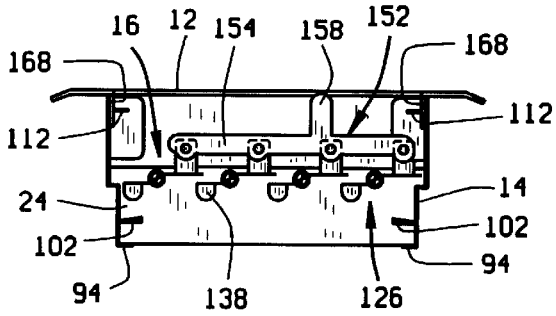
FIG. 18 is an end section view in section of the assembled air vent assembly kit of FIG. 17 along the line 18—18.

The second face plate 18 of the air vent assembly is shown in FIG. 15. The second face plate 18 is also stamped from a flat sheet of metal with a rectangular border 182 that is substantially the same size of the border as the first face plate 12. In addition, the second face plate border 182 is stamped so that it angles downwardly from the top surface of the second face plate in the same manner as the border of the first face plate. The interior area 184 of the second face plate is flat and has a plurality of louvers or vanes 186 formed by cuts having widened, generally U-shapes 188 made in the face plate. Fold lines 192 extend across each of the Ushaped cuts 188 and the louvers or vanes 186 are pressed downwardly below the top surface of the second face plate 18 across the fold lines 192. As seen in FIG. 15, each of the vanes or louvers 186 are formed in the second face plate 18 in two groups that project toward each other. An outer most pair of the vanes 186 have arcuate tabs 194 cut into the vanes. The tabs 194 are bent downwardly from their respective vanes 186 along fold lines 196. FIG. 19 shows the relative positions of the second face plate 18, one of the folded vanes 186 and the arcuate tab 194 folded outwardly from the vane.

The second face plate 18 is assembled to the base 14 in a similar manner to that of the first face plate 12 except that the damper mechanism 16 is not previously assembled into the base. The second face plate 18 is positioned over the base top opening 118 with the arcuate tab projections 194 positioned above the oblong openings 44, 62 in the respective first 22 and second 24 base end walls. The second base plate 18 is then pressed downwardly on the base top opening 118 causing the projecting arcuate tabs 194 to pass into the base interior 116 and engage in the oblong openings 44, 62 in the respective opposite base end walls 22, 24. In this manner, the second face plate 18 is attached to the base without separate fasteners. Because the second face plate 18 does not have the larger lattice openings 166 of the first face plate 12 that provide access to the louver actuator handle 158, the damper mechanism 16 is not used when the second face plate 18 is used in combination with the base 14. The second face plate 18 is intended to be used when the air vent assembly kit comprising the second face plate 18 and the base 14 are employed in covering an air return or air inlet opening of an HVAC system.

Thus, the air vent assembly kit of the invention described above provides a base that can be assembled to either an air outlet opening or an air inlet opening of an HVAC system and interchangeable first and second face plates that can be attached to the base whether covering an air inlet opening or an air outlet opening of the HVAC system. The damper mechanism 16 of the kit can be selectively assembled to the base or left out of the base as desired. Furthermore, because the base end walls and side walls are constructed with lower sections that are spaced inwardly toward each other, a plurality of bases can be nested together and stacked in a compact arrangement for shipping or storage. The damper mechanism 16 and the face plates 12, 18 can also be packaged substantially flat for compact shipping or storing. Still further, by stamped each of the component parts from sheet metal the air vent assembly kit of the present invention is inexpensively manufactured.

While the present invention has been described by reference to specific embodiments, it should be understood that modifications and variations of the invention may be constructed without departing from the scope of the invention defined in the following claims.

What is claimed:

1. An air vent assembly kit for covering an air duct opening, the air vent assembly kit comprising:

a base that is dimensioned to be inserted into an air duct opening;

a damper mechanism that can be selectively connected to the base for movement of the damper mechanism between an opened position and a closed position relative to the base;

a first faceplate that is selectively connectable to the base, a second faceplate that is selectively connectable to the base, the first faceplate and the second faceplate are interchangeable, the first faceplate is connectable to the base when the second faceplate is not connected to the base and the second faceplate is connectable to the base when the first faceplate is not connected to the base; and the first faceplate has a first connector that selectively connects the first faceplate to the base and the second faceplate has a second connector that selectively connects the second faceplate to the base, and the first connector is different from the second connector.

2. The air vent assembly kit of claim 1, wherein:

the first connector can be resiliently flexed relative to the first faceplate and the second connector can be resiliently flexed relative to the second faceplate.

3. The air vent assembly kit of claim 1, wherein:

the base has a plurality of sidewalls that surround an interior volume of the base and the base has opposite top and bottom openings through the plurality of sidewalls to the interior volume, and the first and second faceplates are selectively connectable to the base to cover the top opening of the base.

4. The air vent assembly kit of claim 1, wherein:

the base has a plurality of sidewalls that surround an interior volume of the base and the base has opposite top and bottom openings through the plurality of sidewalls to the interior volume, and the first connector is inserted through the top opening when connecting the first faceplate to the base and the second connector is inserted through the top opening when connecting the second faceplate to the base.

5. The air vent assembly kit of claim 1, wherein:

the base has a plurality of sidewalls that surround an interior volume of the base and the base has opposite top and bottom openings through the plurality of sidewalls to the interior volume, one of the sidewalls has a hole and one of the sidewalls has a projection, and the first connector has a hole that receives the projection on the base sidewall when selectively connecting the first faceplate to the base and the second connector has a tab that is received in the hole in the base sidewall when selectively connecting the second faceplate to the base.

6. The air vent assembly kit of claim 5, wherein:

the base sidewall with the hole and the base sidewall with the projection are separate sidewalls.

7. The air vent assembly kit of claim 5, wherein:

the first faceplate has opposite top and bottom surfaces and the first connector is a projection that projects from the bottom surface and the hole is in the projection;

the second faceplate has opposite top and bottom surfaces and the second connector is a second projection that projects from the bottom surface and the tab is on the second projection.

8. The air vent assembly kit of claim 1, wherein:

the base has a first pair of opposed sidewalls and a second pair of opposed sidewalls that surround an interior volume of the base, the first pair of opposed sidewalls have projections that project into the interior volume and the second pair of opposed sidewalls have holes that open into the interior volume, and the first connectors have holes that receive the projections on the first pair of sidewalls when selectively connecting the first faceplate to the base and the second connectors have tabs that are received in the holes in the second pair of sidewalls when selectively connecting the second faceplate to the base.

9. The vent assembly kit of claim 1, wherein:

the first faceplate has a lattice and the second faceplate has a plurality of louvers.

10. The vent assembly kit of claim 9, wherein:

the first faceplate can be connected to the base when the damper mechanism is connected to the base and the second faceplate cannot be connected to the base when the damper mechanism is connected to the base.

11. An air vent assembly kit for covering an air duct opening, the air vent assembly kit comprising:

a base having a first pair of opposed sidewalls and a second pair of opposed sidewalls that together surround an interior volume of the base, the first pair of opposed sidewalls have projections and the second pair of opposed sidewalls have holes;

a first faceplate that is selectively connectable with the base, the first faceplate having connectors with holes that receive the projections on the first pair of opposed sidewalls of the base when connecting the first faceplate to the base;

a second faceplate that is selectively connectable with the base, the second faceplate having connectors that are different from the connectors of the first faceplate, the second faceplate connectors having tabs that are received in the holes in the second pair of opposed sidewalls of the base when connecting the second faceplate to the base, the first faceplate and second faceplate are interchangeable, the first faceplate is connectable to the base when the second faceplate is not connected to the base and the second faceplate is connectable to the base when the first faceplate is not connected to the base.

12. The air vent assembly kit of claim 11, wherein:

the first faceplate has a lattice and the second faceplate has a plurality of louvers.

13. The air vent assembly kit of claim 11, further comprising:

a damper mechanism that can be selectively connected to the base in the base interior volume for movement of the damper mechanism between an opened position and a closed position relative to the base.

14. The air vent assembly kit of claim 13, wherein:

the first faceplate can be connected to the base when the damper mechanism is connected to the base and the second faceplate cannot be connected to the base when the damper mechanism is connected to the base.

15. The air vent assembly kit of claim 11, wherein:

the base has opposite top and bottom openings to the base interior volume and the first and second faceplates are each selectively connectable to the base over the base top opening.

16. The air vent assembly kit of claim 15, wherein:

the connectors of the first faceplate are inserted through the top opening of the base when attaching the first faceplate to the base and the connectors of the second faceplate are inserted through the top opening of the base when attaching the second faceplate to the base.

17. The air vent assembly kit of claim 11, wherein:

the first faceplate has opposite top and bottom surfaces and the connectors of the first faceplate are projections that project from the bottom surface and the holes are in the projections.

18. The air vent assembly kit of claim 17, wherein:

the second faceplate has opposite top and bottom surfaces and the connectors of the second faceplate are projections that project from the bottom surface and the tabs are on the projections.

19. The air vent assembly kit of claim 18, wherein:

the first faceplate and the projections on the first faceplate are one monolithic piece and the second faceplate and the projections on the second faceplate are one monolithic piece.

* * * * *